US005308031A

United States Patent [19]

Evenson

[11] Patent Number: 5,308,031

[45] Date of Patent: May 3, 1994

[54] LOCKING WALL ACCESSORY FASTENER

[75] Inventor: Mel Evenson, San Pedro, Calif.

[73] Assignee: Eldon Industries, Inc., Los Angeles, Calif.

[21] Appl. No.: 859,283

[22] Filed: Mar. 25, 1992

Related U.S. Application Data

[63] Continuation of Ser. No. 598,252, Oct. 16, 1990, abandoned.

[51] Int. Cl.[5] ..... A47B 96/00

[52] U.S. Cl. ..... 248/222.1; 211/192; 248/243

[58] Field of Search ..... 248/222.1, 243, 222.2, 248/247, 225.2; 211/191, 192, 193

[56] References Cited

U.S. PATENT DOCUMENTS

| | | | |
|---|---|---|---|
| 3,601,432 | 8/1971 | Fenwick | 248/222.1 X |
| 3,757,967 | 9/1973 | Colbridge | 211/191 X |
| 4,048,768 | 9/1977 | Good | 248/222.1 X |
| 4,222,542 | 9/1980 | Wilson et al. | 211/192 X |
| 4,324,379 | 4/1982 | Ovitz, III | 248/222.1 |
| 4,341,486 | 7/1982 | Hammerschlag | 211/192 X |
| 4,684,094 | 8/1987 | Everett | 248/222.1 X |
| 4,733,841 | 3/1988 | Wilson | 248/222.1 |
| 4,971,281 | 11/1990 | Steinbeck | 248/222.1 X |

FOREIGN PATENT DOCUMENTS

| | | | |
|---|---|---|---|
| 948828 | 2/1964 | United Kingdom | 248/222.1 |
| 1123315 | 8/1968 | United Kingdom | 211/192 |

*Primary Examiner*—David L. Talbott
*Attorney, Agent, or Firm*—Price, Gess & Ubell

[57] ABSTRACT

A locking accessory bracket for use with an accessory standard. A locking accessory bracket that may be used with an accessory standard that essentially comprises a flat, straight elongated body portion having a multiplicity of identical, spatially positioned, upwardly projecting, L-shaped hook members located on either side thereof. The locking accessory bracket comprises a flat mounting plate and a hook plate made integral therewith. The hook plate has a plurality of identical, spatially positioned, downwardly projecting, L-shaped hook members, for detachable engagement with desired ones of the multiplicity of upwardly projecting hook members of the accessory standard. The improvement comprises a locking member that is rotatably mounted at a topmost portion of the hook plate. When downwardly projecting hook members of the hook plate are detachably engaged with corresponding ones of the multiplicity of upwardly projecting hook members of the accessory standard, the locking member abuts a bottom portion of an upwardly projecting hook member immediately adjacent to a topmost downwardly projecting hook member of the hook plate. Thus, the position of the locking member substantially inhibits removal of the mounting plate from the accessory standard.

8 Claims, 4 Drawing Sheets

LOCKING WALL ACCESSORY FASTENER

This is a continuation of application Ser. No. 598,252, filed on Oct. 16, 1990, for a LOCKING WALL ACCESSORY FASTENER, now abandoned.

BACKGROUND OF THE INVENTION

1. Field of the Invention

The subject invention relates generally to bracket structures used for attaching accessories to upright accessory standards and, more particularly, to an improved locking accessory bracket for use with an accessory standard.

2. Description of Related Art

One of the problems associated with securing brackets to accessory standard structures, such as those employed with modular wall panels used in the partitioning of office building interiors, is ensuring that the bracket does not separate from the standard. Various locking brackets for use with accessory standards have been developed with this problem in mind.

Prior art modular wall panels have conventionally comprised slotted upright accessory standards that support repositionable brackets attached to shelving and other accessory structures. The slotted standards are usually affixed to a wall panel by an appropriate means and have a plurality of vertically spaced slots disposed therethrough. The brackets typically employ a plurality of L-shape hooks that project through one or more of the slots in the standard.

One of the many disadvantages of the conventional structure is the inability to ensure that the L-shaped hooks of the bracket are securely seated in the slots of the standard, to prevent the bracket from falling off the standard. Another disadvantage is that if an upward external force is applied to the bottom of the bracket, the bracket may become dislodged from the standard, causing harm to persons or property in the vicinity.

Attempts to eliminate these disadvantages typically comprise some form of locking mechanism between the bracket and the standard structures. Of the many different locking mechanism embodiments, some of the more common comprise various configurations of spring-type locking elements. Such a spring-type or resilient locking mechanism is disclosed in U.S. Pat. No. 4,222,452, by H. R. Wilson, et al.

Other locking mechanism embodiments comprise mechanical locking mechanisms. One such mechanical locking mechanism comprises a lever member that is rotatably mounted to a bracket and, when in a desired position, allegedly exerts a force on the slotted accessory standard that is supposedly equal and opposite to an external upward force that may be applied thereto. Examples of mechanical locking mechanisms can be found in U.S. Pat. No. 4,048,768, by W. W. Good, and U.S. Pat. No. 2,576,865, by C. F. Vanderveld.

A common disadvantage of conventional mechanical locking mechanisms is that the lever members employed therein often extend a number of slots above the location where the bracket is retained in the slotted standard, thus limiting the usable length of the slotted standard. Another disadvantage of many mechanical locking mechanisms is that many of the lever members may be substantially wider than the bracket member they are mounted on. If an external upward force is applied thereto, the lever member may become dislodged from the slotted standard, leaving the bracket vulnerable for detachment therefrom.

Finally, none of the conventional mechanical locking mechanisms are compatible with alternate standards that are not slotted. One such standard configuration comprises a flat straight elongated body portion having a multiplicity of identical, spatially positioned upwardly projecting L-shaped hook members located on either side thereof.

As can be appreciated, there exists a need for an improved locking accessory bracket that does not substantially extend above the position of the bracket, which positively secures the bracket to the upright, and that is compatible with alternate accessory standards that are not slotted.

SUMMARY OF THE INVENTION

It is therefore an object of the present invention to provide an improved locking accessory bracket;

It is another object of the invention provide a locking accessory bracket that is capable of retaining a bracket in a desired position when an upward external force is applied to the bracket;

It is another object of the present invention to provide a locking accessory bracket that is compatible with alternate upright accessory standards that are not slotted; and It is another object of the invention to provide a locking accessory bracket that does not limit the usable length of an accessory standard.

These and other objects and advantages of the present invention are achieved by providing an accessory bracket for use with an accessory standard that comprises a flat, straight elongated body portion having a multiplicity of identical, spatially positioned, upwardly projecting, L-shaped hook members located on either side thereof. A flat mounting plate has a hook plate made integral therewith. The hook plate has a plurality of identical, spatially positioned, downwardly projecting, L-shaped hook receiving members, for detachable engagement with the multiplicity of upwardly projecting hook members of the accessory standard.

A locking member is rotatably mounted at a topmost portion of the hook plate, such that when downwardly projecting hook members of the hook plate are detachably engaged with corresponding upwardly projecting hook receiving members of the accessory standard, the locking member abuts a bottom portion of an upwardly projecting hook member immediately adjacent to the topmost downwardly projecting hook member of the hook receiving plate. Thus, the position of the locking member substantially inhibits removal of the locking bracket from the accessory standard.

The features of the present invention which are believed to be novel are set forth with particularity in the appended claims. The present invention, both as to its organization and manner of operation, together with further objects and advantages thereof, may best be understood by reference of the following description, taken in conjunction with the accompanying drawings.

DETAILED DESCRIPTION OF THE INVENTION

The following description is provided to enable any person skilled in the accessory standard art to make and use the invention and sets forth the best modes contemplated by the inventor of carrying out his invention. Various modifications, however, will remain readily apparent to those skilled in these arts, since the generic principles of the present invention have been defined herein specifically to provide a relatively economical process for manufacturing a locking accessory bracket of an improved structure on a production basis.

Figure 1:
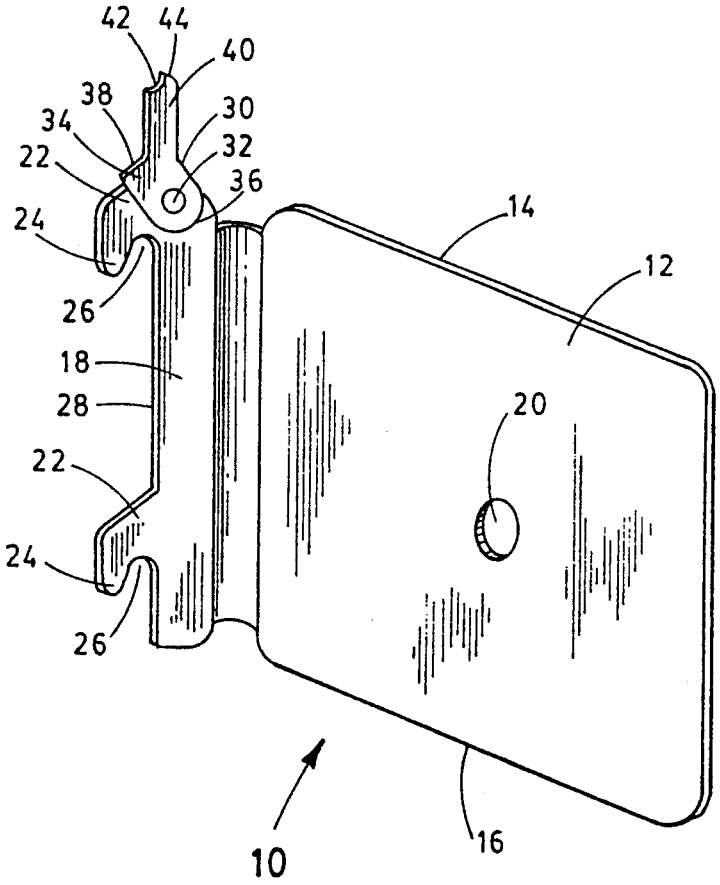
FIG. 1 is a perspective view of a preferred embodiment of a locking bracket according to the present invention.

Referring to FIG. 1, there is shown a locking accessory bracket 10, constructed according to the preferred embodiment. The locking bracket 10 essentially comprises a substantially flat mounting plate 12 having a top 14 and a bottom 16. A substantially flat hook plate 18 extends perpendicularly from the mounting plate 12. The flat mounting plate 12 is for affixing the locking bracket 10 to any of a multiplicity of desired accessories, such as a "Universal Bar", manufactured by Eldon Industries, Inc., for example, that are designed to cooperate with modular wall panels, used in the partitioning of interiors of office buildings. The mounting plate 12 may have at least one opening 20 disposed therethrough in desired locations, where a fastening means, such as a screw (shown in FIG. 2), for example, may be inserted and used to affix a desired accessory to the locking bracket 10.

The hook plate 18 is made integral with the mounting plate 12 at substantially a right angle thereto. The hook plate 18 has at least two identical, spatially positioned, downwardly projecting, L-shaped hook members 22 made integral therewith. Each hook member 22 has an end portion 24 that projects downward and perpendicular to the bottom 16 of the mounting plate 12. The end portion 24 defines a cavity 26 between an outer edge 28 of the hook plate 18 and the end portion 24. The hook members 22 are disposed at equal integer multiples of upwardly projecting hook members of a desired accessory standard (shown in FIG. 2), thus enabling detachable engagement of the locking accessory bracket 10 with the accessory standard.

At a topmost portion of the hook plate 18, a locking member 30 is rotatably mounted. The locking member 30 may be mounted using a suitable fastening means, such as a rivet 32, for example. The locking member 30 comprises a substantially flat, rectangular body portion 34 having two ends: first end 36 being substantially circular, and a second end 38 being substantially straight. A protrusion 40 extends away from the second end 38 at an acute angle thereto. Second end 38 and an inner edge of protrusion 40 form an abutting surface. The protrusion 40 may have a notch 42 located in an end 44 thereof to aid removal of the locking accessory bracket 10 from a desired accessory standard. The locking accessory bracket 10 may be comprised of steel, for example, and manufactured using well know methods.

Figure 2:
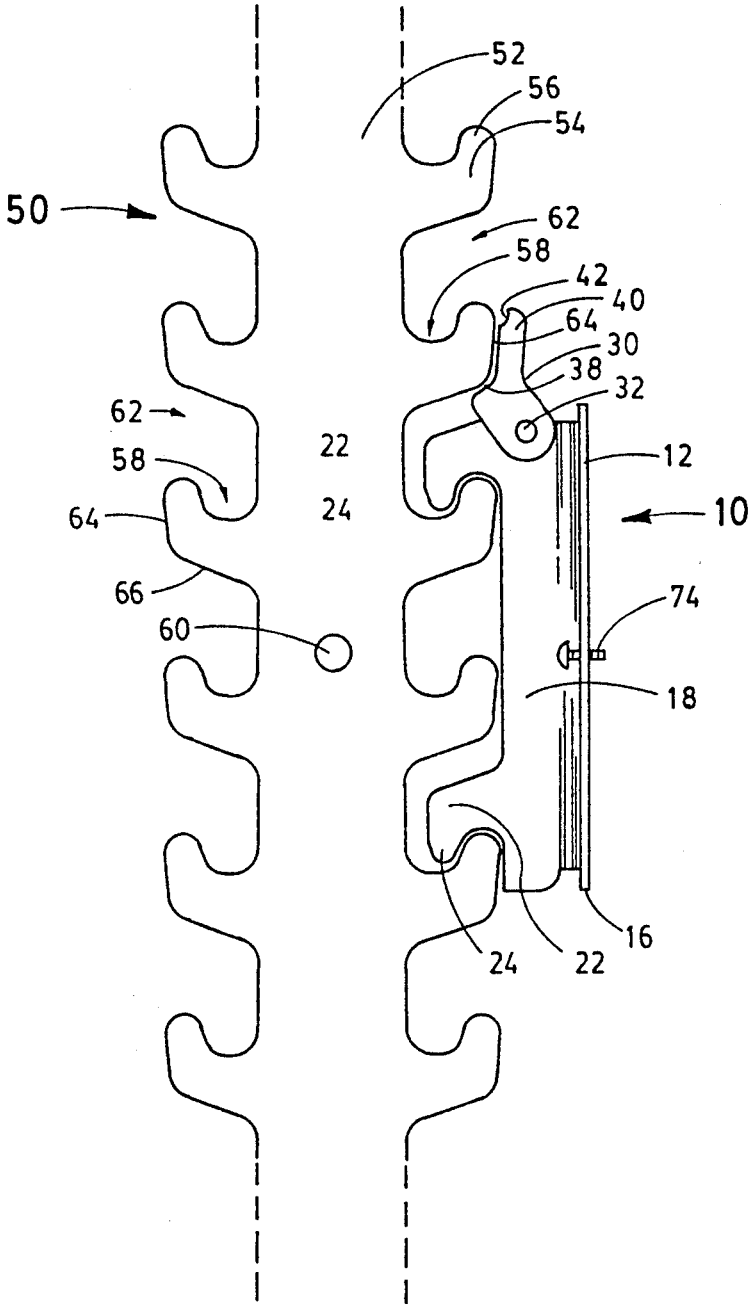
FIG. 2 is a side view of an alternate upright accessory standard and locking detachably mounted to the standard.
Figure 2A:
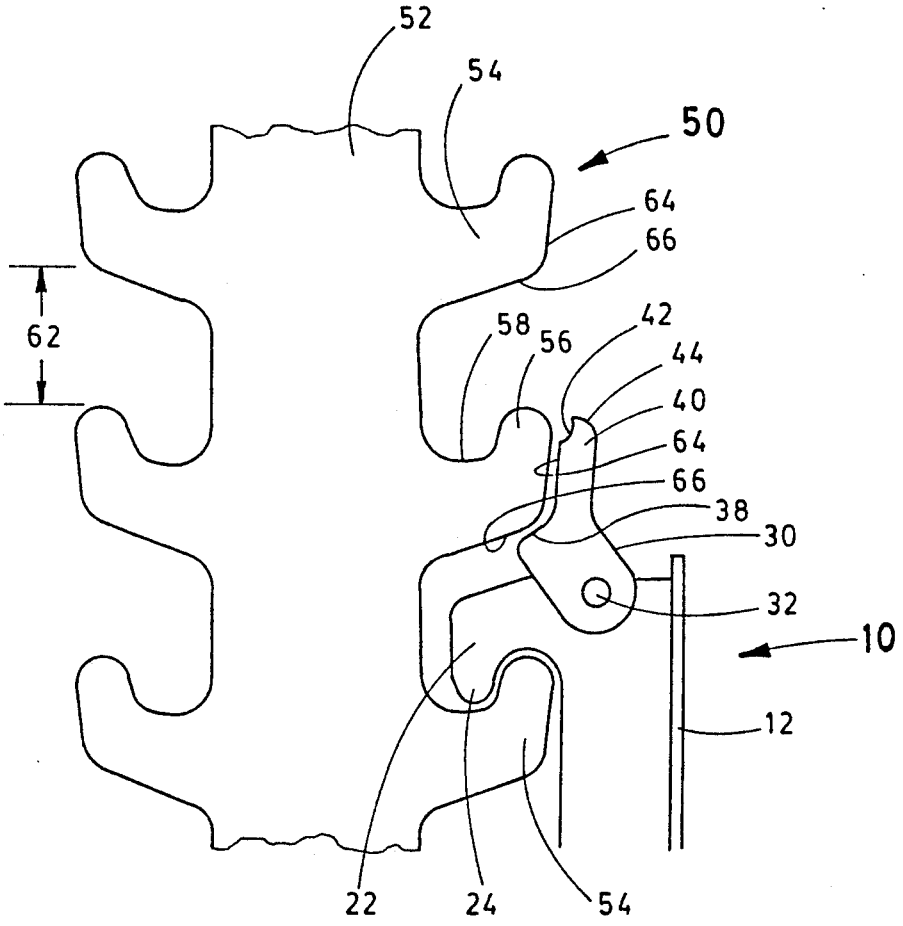
FIG. 2*a* magnified side view of an alternate upright accessory standard and locking bracket detachably mounted to the standard.

Referring now to FIGS. 2 and 2*a*, there is shown a side view of a cross section of a desired upright accessory standard 50 with the preferred locking accessory bracket 10 detachably mounted thereto. The configuration of the accessory standard 50 differs considerably from conventional upright accessory standards, which are typically slotted. The accessory standard 50 comprises a substantially straight elongated body portion 52 and has a multiplicity of identical, spatially positioned, upwardly projecting hook receiving members 54, disposed on either side thereof. The hook receiving members 54 are spatially positioned for forming equal openings 62 between each pair of adjacent hook receiving members 54. Each upwardly projecting hook receiving member 54 has an end portion 56 that projects upward into an adjacent opening 62. An irregular cavity 58 is defined between the end portion 56 and the elongated body portion 52.

Figure 3:
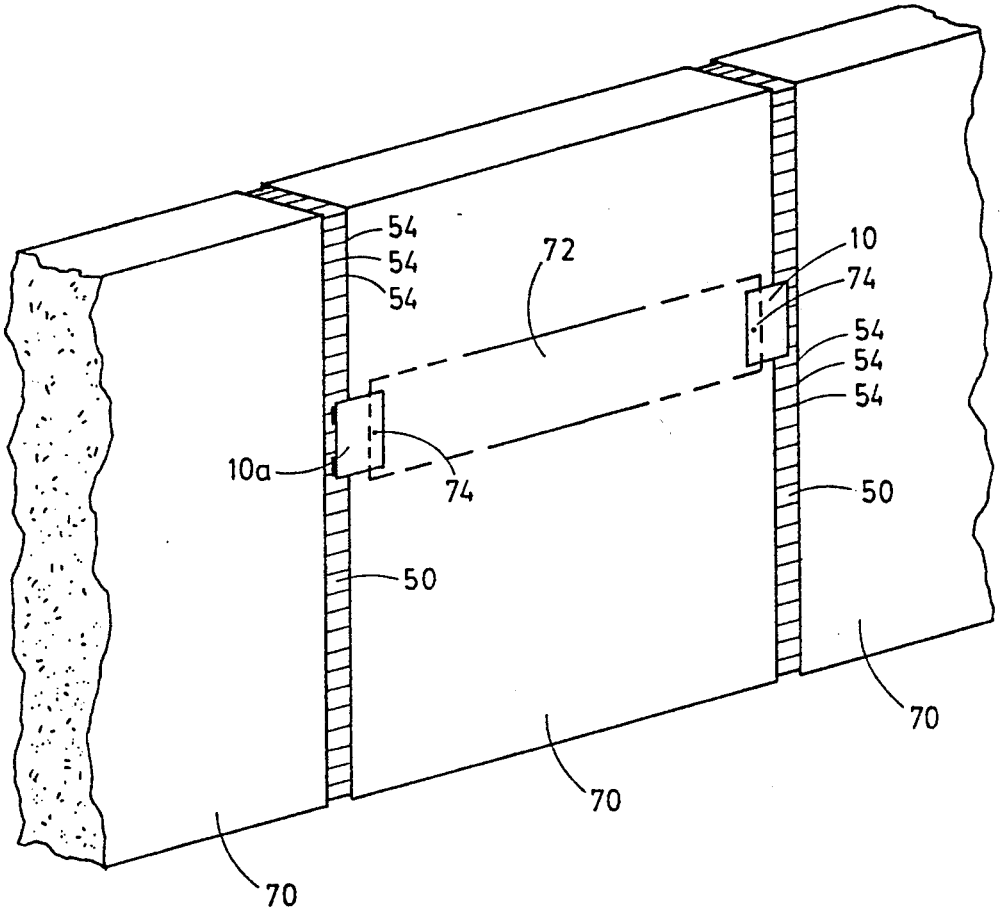
FIG. 3 is a cut-away perspective view showing a pair of the preferred locking brackets as used with a pair of the alternate accessory standards located between abutting ends of modular wall panels.

The accessory standard 50 is adapted to be interposed in a space between a pair of opposed modular wall panels 70 (shown in FIG. 3). The accessory standard 50 is conventionally affixed to an end of a desired wall panel 70, by disposing a layer of adhesive (not shown) on either side of the elongated body portion 52 and pressing the accessory standard 50 against the end of the desired modular wall panel 70. The accessory standard 50 may then be further secured to the wall panel 70 by disposing fastening means, such as a screw, through an opening 60 in the center of the elongated body portion 52. The accessory standard 50 typically has a plurality of such openings 60 to enable substantial retainment thereof to the ends of the modular wall panels 70.

The locking accessory bracket 10 may be demountably attached to the upright accessory standard 50, by first rotating the locking member 30 towards the mounting plate 12. The hook plate 18 of the accessory bracket 10 is then placed against an outer, edge 64 of desired ones of the upwardly projecting hook receiving members 54 of the accessory standard 50, with the downwardly projecting hook members 22 of the hook plate extending into the openings 62. The accessory bracket 10 is then forced downward, causing the downwardly projecting hook members 22 of the hook plate 18 to slide over the upwardly projecting hook receiving members 54, with the end portions 24 of the downwardly projecting hook members 22 extending downward into the accessory standard cavities 58. Simultaneously, the end portions 56 of the upwardly projecting hook receiving members 54 are extending upward into the hook plate cavities 26.

The locking member 30 is then rotated towards an adjacent hook receiving member 54, until it substantially abuts the outer edge 64 and a bottom edge 66 of the adjacent hook receiving member 54. The locking member 30 is formed such that the protrusion 40 thereof, when in abutment with the adjacent hook member 54, is substantially parallel to the outer edge 64 of the adjacent hook receiving member 54 and the end portion 38 of the locking member 30 is substantially parallel to the bottom portion 66 of the adjacent upwardly projecting locking hook receiving member 54.

When the locking accessory bracket 10 is in locked engagement with the accessory standard 50, the end portions 24, 56, of the respective hook receiving members 22, 54 reside in their respective cavities 26, 58, while the locking member 30 substantially abuts the adjacent bottom portion 66 of the adjacent hook receiving member 54, thereby substantially limiting movement of the accessory bracket 10. A force applied to the bottom 16 of the locking accessory bracket 10, would normally cause disengagement of the accessory bracket 10 from the accessory standard 50. However, the engagement of the locking member 30 with the bottom portion 66 of the adjacent hook receiving member 54 substantially inhibits accidental disengagement of the accessory bracket 10 from the accessory standard 50.

If the locking accessory bracket 10 is desired to be removed from the accessory standard 50, a tool, such as a screw driver, may be inserted into the notch 42 in the end 44 of protrusion 40. The locking member 30 may then be rotated away from the accessory standard 50. After the locking member 30 has been removed from the locked position, the accessory bracket 10 can be lifted away from the accessory standard 50.

FIG. 3 shows an example of a use of the invented accessory bracket 10. A pair of accessory standards 50 are interposed between three modular wall panels 70. The accessory standards 50 are affixed between modular wall panels 70 using the previously discussed methods. A locking accessory bracket 10 and its complement 10*a* are detachably mounted to the accessory standards 50 using the discussed methods. The accessory brackets 10, 10*a* are affixed to an accessory 72, which comprises a modular bar, for example only, using a fastening means such as a screw 74 (best seen in FIG. 2).

While the above features of the present invention teach a locking accessory bracket of an improved configuration, it can be readily appreciated that it would be possible to deviate from the above embodiments of the present invention and, as will be readily understood by those skilled in the art, the invention is capable of many modifications and improvements within the scope and spirit thereof. Accordingly, it will to be understood that the invention is not to be limited by the specific embodiments but only by the spirit and scope of the appended claims.

What is claimed is:

1. An improved bracket for securing a desired accessory to an upright accessory standard, said standard being located in a space between opposed ends of a pair of modular wall panels and having a substantially flat elongated body portion and having a multiplicity of identical, spatially positioned upwardly-projected L-shaped hook-receiving members located on either side thereof and defining a plurality of apertures therebetween, wherein the apparatus comprises:

a flat mounting plate having a top and a bottom;

a flat hook plate made integral with the mounting plate, said hook plate being disposed at a substantially right angle to the mounting plate and having a plurality of identical spatially positioned downwardly projecting L-shaped hook members for detachable engagement with one or more upwardly-projecting L-shaped hook-receiving members of said accessory standard;

a flat locking member comprised of a substantially rectangular body portion having a proximate end and a distal end, the proximate end of the rectangular body portion being rotatably mounted at a topmost portion on a single side of said hook plate in close proximity to a topmost hook member thereof, the distal end being substantially straight;

a protrusion integrally formed with a portion of the distal end of the rectangular body portion, an inner edge of said protrusion and a portion of the distal end of the rectangular body portion forming an abutting surface;

said locking member having a width which is not substantially wider than a width of said hook plate such that both may fit into an aperture between a pair of hook-receiving members in the space between the opposed pair of modular walls;

said substantially rectangular body portion having a length defined between said proximate end and said distal end which is sized whereby, when the downwardly projecting hook members of said hook plate are detachably engaged with upwardly-projecting L-shaped hook-receiving members of said accessory standard, said abutting surface may be pivoted toward and into an aperture in which a topmost hook member is engaged and abut along both bottom and outer portions of an L-shaped hook-receiving member immediately above said aperture to inhibit removal of said mounting plate from said accessory standard.

2. The improved bracket of claim 1 further comprising a fastening means for rotatably mounting said locking member to said hook plate.

3. The improved bracket of claim 2 wherein said fastening means comprises a rivet.

4. The improved bracket of claim 1 wherein said mounting plate, said hook plate, and said locking member are comprised of a metal alloy.

5. A bracket for securing an accessory to a standard having a plurality of upwardly-projecting hook-receiving members that are located in a space between opposed ends of a pair of modular walls, said bracket comprising:

a flat mounting plate;

a flat hook plate made integral with the mounting plate and having at least one L-shaped hook member extending from a topmost portion of the hook plate, said L-shaped hook member detachably engaging an aperture formed between two of said hook-receiving members of said standard;

a flat locking member having a substantially rectangular body portion with a proximate end and a distal end, the proximate end of the rectangular body portion being rotatably attached to the topmost portion on a single side of said hook plate and in close proximity to said L-shaped hook member extending therefrom;

a protrusion integrally formed with a portion of the distal end of the rectangular body portion, an inner edge of said protrusion and a portion of said distal end of the rectangular body portion forming an abutting surface;

said locking member having a width which is not substantially wider than a width of said hook plate such that both may fit into an aperture between a pair of hook-receiving members in the space between the opposed pair of modular walls;

said substantially rectangular body portion having a length defined between said proximate end and said distal end which is sized whereby, when said L-shaped hook member is engaged with a particular aperture, said abutting surface may be rotated into said aperture against an L-shaped hook-receiving member immediately above said aperture, to inhibit inadvertent disengagement of said L-shaped hook member from said particular aperture.

6. The bracket of claim 5 wherein the hook plate extends from said mounting plate at substantially a right angle.

7. An improved bracket for mounting to an upright accessory standard, said standard having a plurality of identical upwardly-projecting hook-receiving members that define a plurality of apertures therebetween and that are located in a space between opposed ends of a pair of modular walls, wherein the apparatus comprises:

a flat hook plate having at least one downwardly-projecting hook member for detachable engagement with a first upwardly-projecting hook-receiving member of the accessory standard; and a flat locking member having a proximate end and a distal end, the proximate end being rotatably mounted near a topmost portion on a single side of said hook plate, said distal end having an abutting surface complementarily shaped with lower, outer edges of hook-receiving members of said accessory standard;

said locking member having a width which is not substantially wider than a width of said hook plate such that both may fit into an aperture between a pair of hook-receiving members in the space between the opposed pair of modular walls;

said locking member being sized and positioned whereby, when the downwardly-projecting hook member of the hook plate is detachably engaged with a first upwardly-projecting hook-receiving member of the accessory standard, the abutting surface of the locking member fits within the space between the modular walls and abuts the lower outer edge of a second upwardly-projecting hook-receiving member positioned immediately above said first hook-receiving member.

8. The improved bracket of claim 7, wherein the lower, outer edge of the upwardly-projecting hook-receiving members of the accessory are generally curved and the abutting surface of the locking member is generally curved.

* * * * *